US005500275A

United States Patent [19]

Kemper

[11] Patent Number: 5,500,275

[45] Date of Patent: Mar. 19, 1996

[54] NEEDLE BAR

[76] Inventor: Rainer Kemper, Westerwaldstr. 14, 6053 Obertshausen, Germany

[21] Appl. No.: 392,383

[22] Filed: Feb. 22, 1995

Related U.S. Application Data

[62] Division of Ser. No. 189,112, Jan. 31, 1994, Pat. No. 5,453,146.

[30] Foreign Application Priority Data

Feb. 2, 1993 [DE] Germany ..... 43 02 858.6

[51] Int. Cl.[6] ..... B32B 3/28; D05B 55/02

[52] U.S. Cl. ..... 428/167; 428/172; 428/212; 112/226

[58] Field of Search ..... 428/156, 167, 428/212, 137, 192, 332; 112/226, 221, 222, 227

[56] References Cited

U.S. PATENT DOCUMENTS

| | | | |
|---|---|---|---|
| 4,014,278 | 3/1977 | Jolley et al. | 112/226 |
| 4,154,176 | 5/1979 | Spanel et al. | 112/79 R |
| 4,157,690 | 6/1979 | Lund et al. | 112/226 |

*Primary Examiner*—Donald J. Loney

[57] ABSTRACT

A needle bar is made from a support member and a carrier. The needle bar can be made with a plurality of needle grooves. The bar is made by adhering the support member to the carrier. Then the support member is divided into a plurality of individual segments of predetermined length, after the support member is adhered to the carrier. Adjacent ones of the individual segments (a) can be spaced to form a gap narrower in width than the needle grooves, and (b) can have opposing edges shaped to form a concavity having a width equivalent to the needle grooves.

8 Claims, 1 Drawing Sheet

NEEDLE BAR

This application is a division of application Ser. No. 08/189,112, filed Jan. 31, 1994, now U.S. Pat. No. 5,453, 146.

BACKGROUND OF THE INVENTION

FIELD OF THE INVENTION

The invention is directed to a process for the production of a needle bar and to the needle bar itself, having a support member adhered to a carrier.

DESCRIPTION OF THE PRIOR ART

A process of this general type is disclosed in DE 41 11108A 1. There a carrier formed as a hollow profile member is provided with a metallic layer adhered thereto for the takeup of the needles, which acts as the support member. When the carrier and the support member are made of different materials, the danger exists that during temperature changes, forces are transferred from the support member to the carrier, which leads to deformation of the needle bar and thus improper placement of the needles. In order to avoid this occurrence, it is customary, in the known procedure, to operate with individual segments. These segments are provided with a space at their contact points. Such a procedure is however difficult to implement where very fine needle spaces are required, since, because of the fine needle separations, a very exact positioning of the individual segments must be maintained. To all intents and purposes, given acceptable expenditures, it is not possible to exactly align the segment to correspond to the needle separations.

Accordingly there is a need for a procedure whereby in a simple manner, a needle bar can be created having finely divided needle spaces.

SUMMARY OF THE INVENTION

In accordance with the illustrative embodiments demonstrating features and advantages of the present invention, there is provided a process for the production of a needle bar having a support member and a carrier. The process includes the step of adhering the support member to the carrier. Another step is dividing length, after the support member is adhered to the carrier.

A related needle bar according to the principles of the present invention has a carrier and a support member adhered to the carrier. The support member has a plurality of needle grooves. The support member is divided into a linearly aligned plurality of individual segments of predetermined length. Adjacent ones of the individual segments (a) are spaced to form a gap narrower in width than the needle grooves, and (b) have opposing edges shaped to form a concavity having a width equivalent to the needle grooves.

In a preferred embodiment a support member is fabricated with an improved process by dividing the support member, after adhesion, into individual segments of predetermined length.

By proceeding in this manner, one will affix the portions or segments in the desired positions relative to each other upon the carrier. At the moment of adhesion they are properly positioned with respect to each other, because the support member is unitary. With the initially unitary support member on the carrier, it is possible to utilize known means to obtain later the desired exactness of separation. The relationship of the individual segments to each other is not altered by subsequent division. Thus, the influence of temperature changes upon the needle bar can be substantially minimized.

It is advantageous if needle grooves can be formed in the support member and, subsequently, the division of the said support member into individual segments is performed at a needle groove. Thus, this division also takes place at a position where the support member is already somewhat thinner. On the one hand, this saves work, on the other hand, the weakening of the support member caused by the division can be held as small as possible. The individual ridges between the needle grooves are practically untouched.

In an especially preferred mode, the divisional lines between the individual segments are narrower than the needle grooves. Thus the guiding of the individual needles overlaying the dividing line is practically uninfluenced by the dividing line. Furthermore, the needle can thus readily slide on the base of the needle groove.

It is also especially preferred if the divisional line is milled. This is the quickest mode of formation, which can be carried out with the desired exactness.

Preferably the dividing line has a width in the order of about 0.1 mm; suitably between about 0.05 and 0.15 mm. This is relatively small. However, since the dividing line need only take into account the expansion of the individual segments from temperature variations, this breadth of the dividing line is sufficient.

It is further preferred that the individual segments are approximately 5 to 10 cm in length. Since the expansion of individual segment is proportional to its length, this size range ensures that the individual segments of the support member do not contact each other due to changes in temperature.

It is also advantageous to make the carrier from a fiber reinforced, particularly a carbon fiber reinforced, synthetic material such as epoxy resins, poly-phenyl sulfides, polyethersulfones, or polysulfones. The support member can be made from a light metal, in particular, aluminum may be used. This ensures the production of very light needle bars with the appropriate rigidity.

DESCRIPTION OF THE DRAWINGS

The invention may be described in its preferred embodiments by the following description in conjunction with the following drawings, which show.

DETAILED DESCRIPTION OF THE PREFERRED EMBODIMENTS

Figure 1:
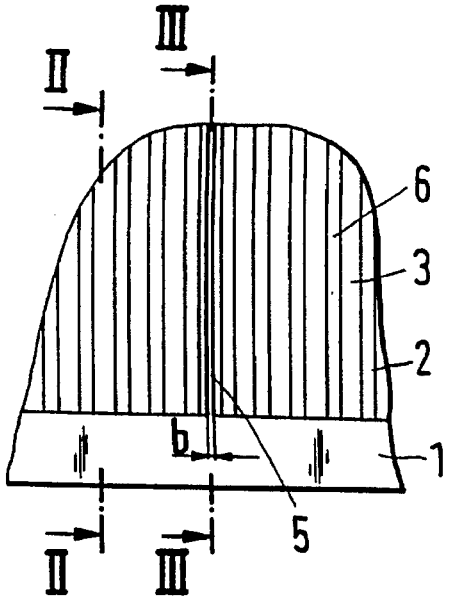
FIG. 1 is a side elevational view of a portion of a needle bar according to principles of the present invention.
Figure 2:
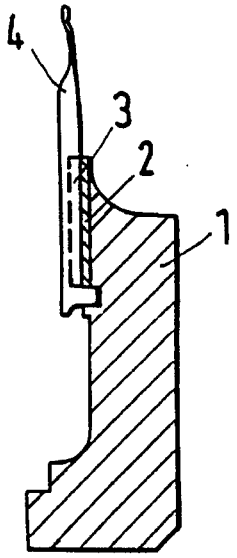
FIG. 2 is a cross-sectional view taken along line II—II of FIG. 1.
Figure 3:
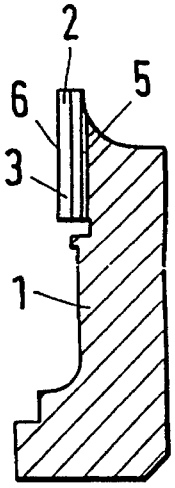
FIG. 3 is a cross sectional view taken along line III—III of FIG. 2.

An aluminum ledge 2 is glued onto a needle bar having a support member 1 made of carbon fiber reinforced, synthetic material. The length of this aluminum ledge is as great as the need for needles on a needle bar at a particular site based on the number and density needles.

Ledge 2 is adhered to the support member 1 by an appropriate glue although other fastening means, such as screws, are contemplated as well. After adhering the aluminum ledge 2, grooves 3 for slider needles 4, are cut therein, but only as deep as is required for the placement of slider needles 4 therein. Grooves 3 are preferably formed by milling, although sawing and other forms of cutting can be performed as well. Between the grooves 3 protrusions or ridges 6 remain, which guide the slider needles 4 in the usual manner.

After grooves 3 are milled into the adhered aluminum ledge 2 at short distances from each other say, between 0.7 and 0.8 mm (although the groove to groove spacing will depend on the specific application). Separation grooves or divisional lines 5 are also milled at short distances from each other say, between 7 and 8 centimeters. These lines 5 cut through the aluminum ledge 2 completely.

These divisional lines 5 are located in the base of a groove 3. The lines 5 have a breadth (b) of about 0.1 mm. They are thus narrower than the width of groove 3. They are also narrower than the breadth of a slider needle 4. The slider needles 4 can therefore be readily placed in the grooves in which the divisional lines 5 are created.

The thus produced needle bar comprises a plurality of segments in the aluminum ledge 2, which have an exceedingly precise relationship to each other, despite the fact that they are separated from each other. Thus, tensions which occur between the needle bar profile 11 and the aluminum ledge 2 because of temperature changes, bring about no negative results.

Obviously, many modifications and variations of the present invention are possible in light of the above teachings. It is therefore to be understood that within the scope of the appended claims, the invention may be practiced otherwise than as specifically described.

I claim:

1. A needle bar comprising:

a carrier; and a support member adhered to said carrier and having a plurality of needle grooves, said support member being divided into a linearly aligned plurality of individual segments, adjacent ones of said individual segments (a) being spaced to form a gap narrower in width than said needle grooves, (b) having opposing edges, and (c) having adjacent to each of said opposing edges a concavity recessed from each of said opposing edges to form between concavities on opposite sides of said gap, a space having a width equivalent to the needle grooves.

2. A needle bar in accordance with claim 1 wherein said gap has a breadth in the range of no more than 0.15 mm.

3. A needle bar in accordance with claim 1 wherein said gap has a breadth in the range of approximately 0.05 mm to 0.15 mm.

4. A needle bar in accordance with claim 2 wherein said individual segments have a length of between 5 and 10 cm.

5. A needle bar in accordance with claim 1 wherein said carrier comprises synthetic material reinforced with fibers.

6. A needle bar in accordance with claim 2 wherein said carrier comprises synthetic material reinforced with fibers.

7. A needle bar in accordance with claim 1 wherein said carrier comprises synthetic material reinforced with carbon fibers.

8. A needle bar in accordance with claim 7 wherein said support member comprises aluminum.

* * * * *

UNITED STATES PATENT AND TRADEMARK OFFICE

CERTIFICATE OF CORRECTION

PATENT NO. : 5,500,275

DATED : March 19, 1996

INVENTOR(S) : Rainer Kemper

It is certified that error appears in the above-identified patent and that said Letters Patent are hereby corrected as shown below:

Title page, item [73], Karl Mayer Textilmaschinenfabrik GmbH
Obertshausen, Germany Signed and Sealed this Twenty-sixth Day of November 1996

*Attest:*

Bruce Lehman

BRUCE LEHMAN

*Attesting Officer*

*Commissioner of Patents and Trademarks*